US007823665B2

(12) United States Patent
Sullivan et al.

(10) Patent No.: US 7,823,665 B2
(45) Date of Patent: Nov. 2, 2010

(54) MILLING OF CEMENTED TUBULARS

(75) Inventors: Michael Sullivan, Katy, TX (US); Thomas M. Redlinger, Houston, TX (US); Hubert E. Halford, Rosharon, TX (US); Thomas F. Bailey, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 331 days.

(21) Appl. No.: 11/834,764

(22) Filed: Aug. 7, 2007

(65) Prior Publication Data

US 2008/0035377 A1 Feb. 14, 2008

Related U.S. Application Data

(60) Provisional application No. 60/821,757, filed on Aug. 8, 2006.

(51) Int. Cl.
*E21B 10/43* (2006.01)

(52) U.S. Cl. ..... 175/425; 175/79

(58) Field of Classification Search ..... 175/79, 175/81, 57, 406, 425, 426
See application file for complete search history.

(56) References Cited

U.S. PATENT DOCUMENTS

| | | | | |
|---|---|---|---|---|
| 122,514 A | | 1/1872 | Bullock | |
| 1,077,772 A | | 11/1913 | Weathersby | |
| 3,211,244 A | | 10/1965 | Cordary | |
| 3,282,358 A | | 11/1966 | Carothers | |
| 3,726,351 A | * | 4/1973 | Williams, Jr. | 175/426 |
| 4,024,902 A | * | 5/1977 | Baum | 164/97 |
| 5,027,914 A | * | 7/1991 | Wilson | 175/406 |
| 5,584,350 A | * | 12/1996 | Schnitker et al. | 175/61 |
| 5,887,668 A | * | 3/1999 | Haugen et al. | 175/79 |
| 6,024,168 A | * | 2/2000 | Kuck et al. | 166/297 |
| 6,092,604 A | | 7/2000 | Rice et al. | |
| 6,131,675 A | * | 10/2000 | Anderson | 175/268 |
| 6,443,247 B1 | | 9/2002 | Wardley | |
| 6,742,611 B1 | | 6/2004 | Illerhaus et al. | |
| 7,216,727 B2 | | 5/2007 | Wardley | |
| 2007/0023188 A1 | | 2/2007 | Roberts et al. | |

FOREIGN PATENT DOCUMENTS

| | | |
|---|---|---|
| GB | 1 306 568 | 2/1973 |
| GB | 2 170 528 | 8/1986 |

OTHER PUBLICATIONS

GB Search Report, Application No. GB0715115.2, dated Nov. 20, 2007.

* cited by examiner

*Primary Examiner*—Daniel P Stephenson
(74) *Attorney, Agent, or Firm*—Patterson & Sheridan, LLP

(57) ABSTRACT

A method and apparatus for milling an item in a wellbore. The method and apparatus including providing a milling tool having one or more blades which are geometrically configured to resist deflection by distributing cutting forces in multiple directions.

29 Claims, 11 Drawing Sheets

MILLING OF CEMENTED TUBULARS

CROSS-REFERENCE TO RELATED APPLICATIONS

This application claims benefit of U.S. Provisional Patent Application Ser. No. 60/821,757, filed Aug. 8, 2006, which application is incorporated herein in its entirety.

BACKGROUND OF THE INVENTION

1. Field of the Invention

Embodiments described herein generally relate to a milling tool. More particularly, the embodiments relate to a milling tool having a blade configured for increased stiffness. More particularly still, embodiments relate to an angled or bent blade adapted to increase the life span of the tool.

2. Description of the Related Art

During the drilling and production of oil and gas wells, a wellbore is formed in the earth and typically lined with a tubular that is cemented into place to prevent cave ins and to facilitate isolation of certain areas of the wellbore for collection of hydrocarbons. During drilling and production, a number of items may become stuck in the wellbore. Those items may be cemented in place in the wellbore and/or lodged in the wellbore. Such stuck items may prevent further operations in the wellbore both below and above the location of the item. Those items may include drill pipe or downhole tools. In order to remove the item milling tools are used to cut or drill the item from the wellbore.

Typical milling tools have blades which extend from the milling tool. The blades often extend from a face of the mill. Such blades are limited in length because the low torsional rigidity and low resistance to deflection when lengthened. The blades typically have a cutting surface which is coated or covered with a cutting material such as crushed tungsten carbide in a nickel silver matrix. Typically a blade provides a support structure for the cutting material. As the milling tool is rotated, the cutting surface will cut through the stuck item while also wearing through the cutting material and the blade. Because the blades are substantially flat and extend from the face in a cantilevered fashion, there are substantial limits on the length and life of the milling tool. As the length of the blade is increased the blades resistance to deflection decreases. This deflection can cause the bond between the cutting material and the blade to fail, thereby increasing the wearing of the blade. The blade will wear out at a rapid rate or break as the deflection increases. Typical blades extend one and a half inches, or less, from the face of the milling tool. When the blade is lengthened beyond one and a half inches the blade deflection increases causing rapid wear and damage to the blade. The life and rate of penetration of a milling tool will directly affect increase the rig time and the wellbore will remain inaccessible until the stuck item is removed.

While milling an item downhole, a phenomenon called coring can occur. Coring occurs when blades at the center of the milling tool are worn down at an increased rate which causes an inversed cone shaped formation in the center of the mill. The blades are worn down at an increased rate toward the center of the blade due to the slower surface speed of the mill at the center than at the edges. The slower speed causes increased friction and wear of the blades. Coring leaves a circular area without a cutting device in the center of the mill face. As the mill cuts deeper into the stuck item, some items in contact with the circular area of the mill bit center are not cut and thus creates a core. The core pushes on the mill and may prevent the mill from cutting deeper into the item, or penetrate the milling tool. Reducing coring can increase the life span and effectiveness of a mill.

There is a need for a method and apparatus to increase the longevity and the effectiveness of downhole mill bits. Therefore, there is a need for a milling tool with an increased resistance to deflection.

SUMMARY OF THE INVENTION

In accordance with the embodiments herein there is provided generally a milling tool for use in a wellbore. The milling tool has a body having a connector end and a milling end. The connector end is configured to couple the body to a conveyance. The milling end has a face, one or more blades coupled to the face, at least one of the blades having a height dimension which extends beyond the face and a length dimension, wherein at least a portion of the length dimension couples to the face in a non-planar configuration along one side of the blade.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of apparatus and methods for milling an item in a wellbore are provided. In one embodiment, a milling tool is configured to have blades that are geometrically designed to increase the life and penetration of the mill. The milling tool is coupled to a conveyance, such as a drill pipe or coiled tubing, and lowered into a wellbore. The milling tool is lowered until it reaches an item that is stuck in the wellbore, such as a drill pipe. The item in the wellbore may prevent use of the wellbore below the item. The milling tool then engages the item while the milling tool is rotated. The geometric configuration of the milling tool has an increased resistance to deflection and torsion. The increased resistance to deflection and torsion allows the blades to be longer than those of conventional milling tools. The increased length increases the life and penetration achieved by the milling tool. The milling tool continues to mill through the item until access to the wellbore has been regained. The milling tool is then removed from the wellbore, and drilling and/or production operations may proceed in the wellbore.

Figure 1:
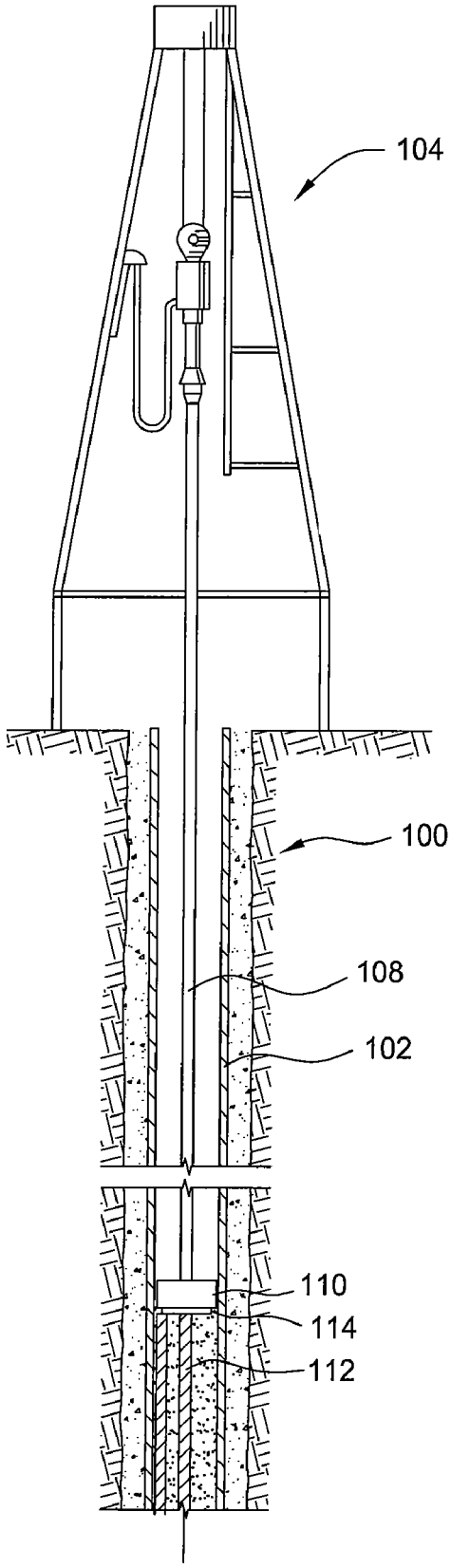
FIG. 1 illustrates a schematic of a wellbore with a milling tool according to one embodiment of the present invention.

FIG. 1 shows a wellbore 100 with a casing 102 cemented in place, a drill rig 104, a conveyance 108, a milling tool 110, and an item 112 stuck in the wellbore 100. The conveyance 108 may be a drill string which may be rotated and axially translated from the drill rig 104; however, it should be appreciated that the conveyance could be any conveyance such as a co-rod, a wire line, a slick line, coiled tubing, casing. The milling tool 110 may be coupled to a drilling motor (not shown) in order to rotate the milling tool in a manner independent from the conveyance. The conveyance 108 is connected to the milling tool 110 at its lower end. The milling tool 110, as will be described in more detail below, is lowered into the wellbore 100 until it engages the item 112 that is stuck in the wellbore. The item 112, as shown, is a drill pipe which has been cemented into place; however, the item 112 could be any suitable item stuck in the wellbore 100 including, but not limited to: casing, production tubing, liner, centralizers, whipstocks, packers, valves, drill bits, drill shoes. Optionally, the item 112 may be cemented in place in the wellbore 100. Preferably, the milling tool 110 engages the item 112 while the milling tool 110 rotates. A milling end 114 of the milling tool 110 then mills away the item 112 and any cement attached to the item 112. The milling tool 110 may have one or more blades which may be geometrically configured to resist deflection. The milling tool 110 is lowered while rotating and milling until the item 112 is no longer obstructing the wellbore 100.

Figure 2:
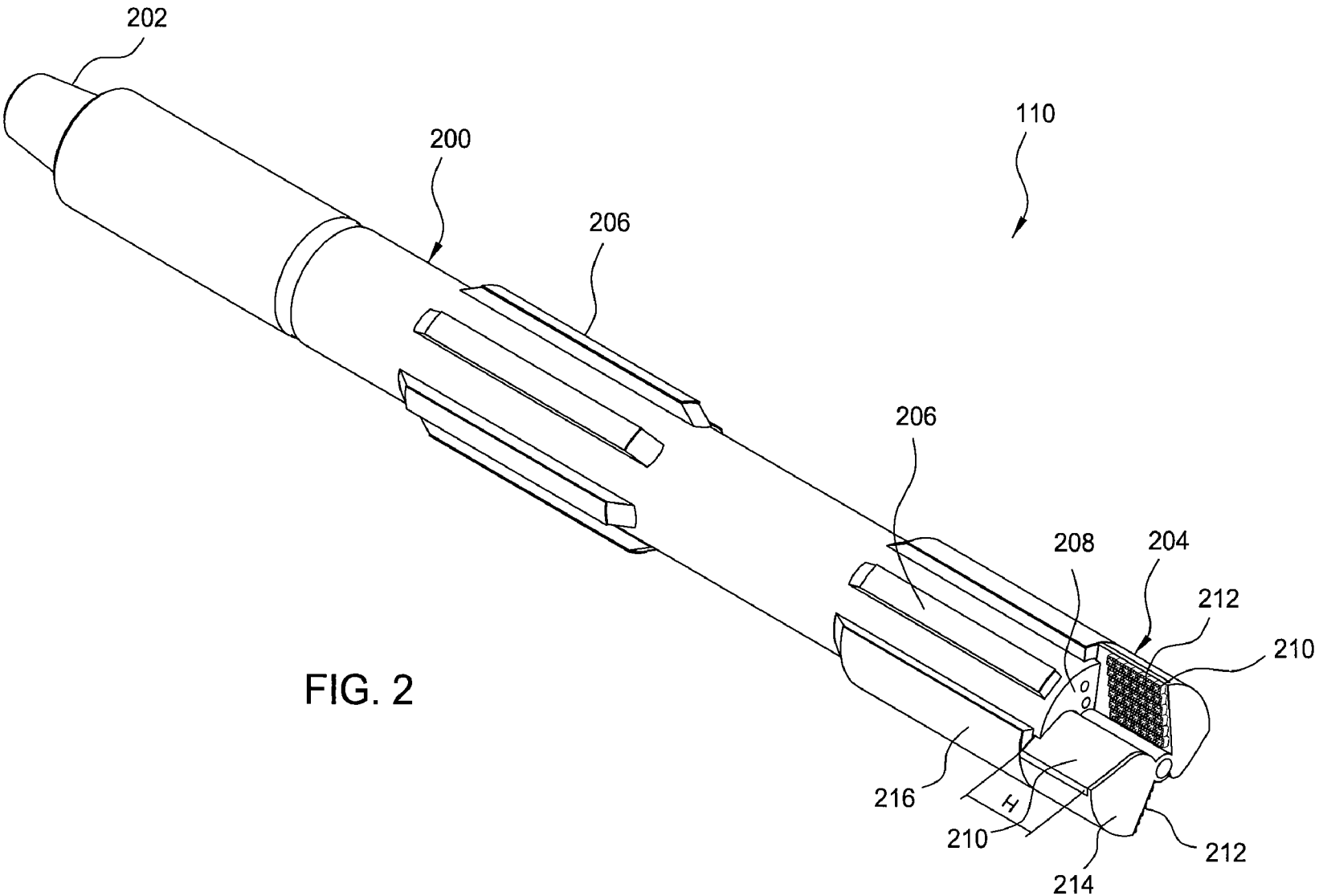
FIG. 2 is a perspective view of a milling tool according to one embodiment of the present invention.

FIG. 2 is a perspective view of the milling tool 110. The milling tool 110 has a body 200 with a connector end 202 and a milling end 204. The connector 202, as shown, is simply a threaded connection member to coupling the milling tool to the conveyance 108. The body 200, as shown, is a cylindrical member adapted for transferring rotation from the conveyance 108 to the milling end 204. The body 200 may be of any suitable length or shape so long as it is capable of transferring rotation and axial force to the milling end 204 of the body 200. The body 200 may optionally include one or more stabilizers 206 for centering and stabilizing the milling tool 100 during milling.

The milling end 204, as shown, has a face 208, one or more blades 210, one or more cutting structures which may include any combination of one or more inserts 212, an amorphous structure 214, and a reinforcing member 216. The face 208 may be a substantially flat end of the body 200 adapted to couple one or more blades 210, the amorphous structure 214, and other members, (not shown), to the body 200. The one or more blades 210 have a height H which extends beyond the face 208 of the milling tool 110. The one or more blades 210 may be geometrically configured to resist deflection, as will be described in more detail below. The amorphous structure 214 may be arranged to increase the one or more blades' 210 resistance to deflection and torsion, while increasing the rate of penetration of the milling tool 100, as will be described in more detail below.

Figure 3:
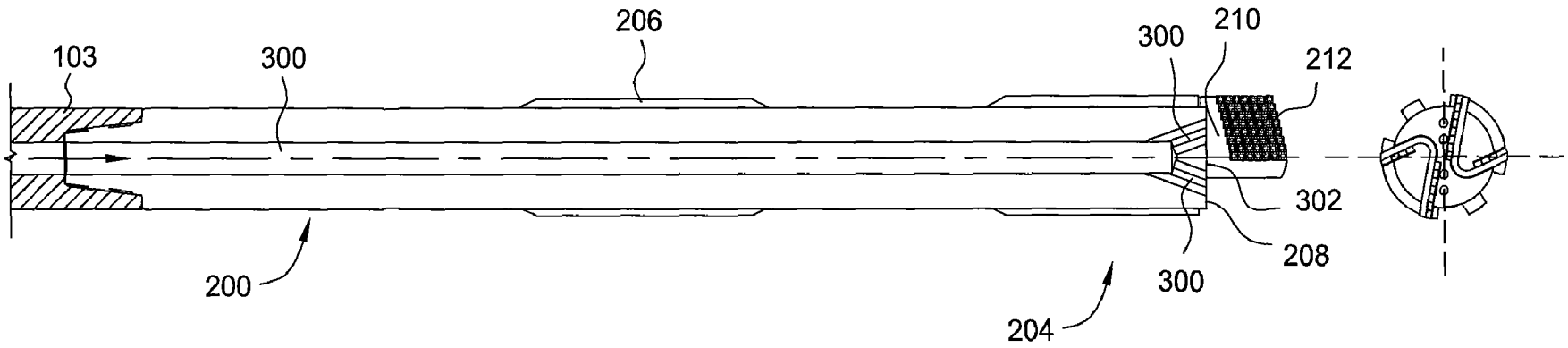
FIG. 3 is a cross sectional view of a milling tool according to one embodiment of the present invention.

FIG. 3 shows a cross sectional view of the milling tool 110. The body 200 is shown having a flow path 300 for conveying fluid from the conveyance 108 to the face 208. As shown, the flow path 300 splits into two paths near the face 208; however, it should be appreciated that there could be any suitable number of paths at the face 208. The flow path 300 may convey fluids, such as drilling mud, to the milling end 204 of the milling tool 110 in order to lubricate and cool the milling tool 110 and wash away any cuttings that are created during milling. The flow path 300 delivers the fluid to the side of the one or more blades 210 having the inserts 212.

The one or more blades 210 may be embedded into the face 208. This may be accomplished by creating a groove (not shown) in the face 208 to correspond with the geometry of a coupling end 302 of the corresponding blade 210. The coupling end 302 of the blade 210 may be located in the groove and secured to the face 208 by welding or other suitable connection methods. The coupling end 302 of the blade may also be welded directly to the face and not embedded.

In an alternative embodiment, the one or more blades 210 may be integral with the milling end 204 of the milling tool 110. In this embodiment, one or more of the blades 210 may be constructed from the milling tool 110. For example, the blade 210 may be milled from a piece of metal when forming the milling tool 110, or cast with the milling tool 110. In this embodiment, the one or more blades 210 are all form one piece of the milling tool 110.

Figure 4:
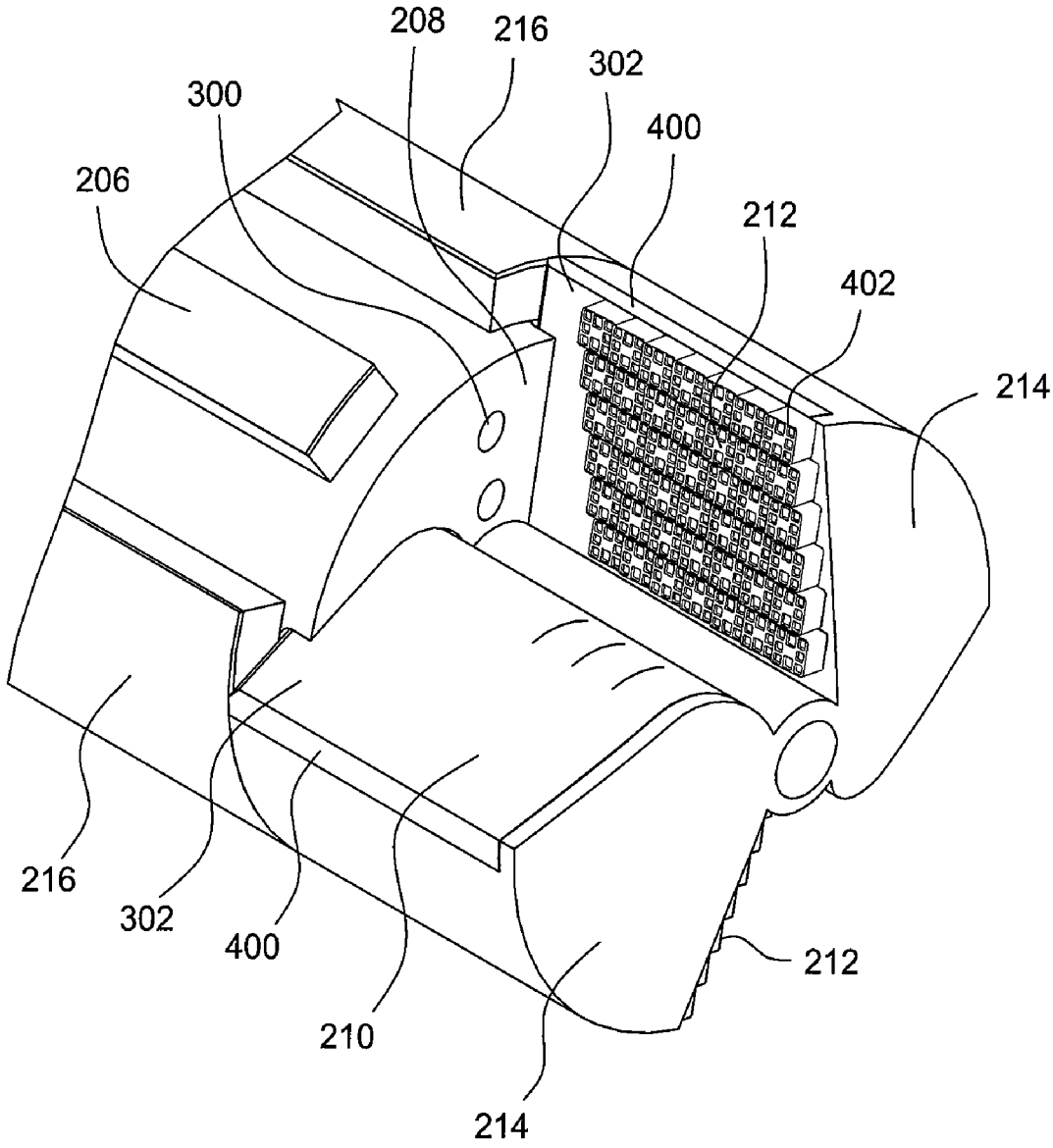
FIG. 4 is a perspective view of a milling end of the milling tool according to one embodiment of the present invention.
Figure 5A:
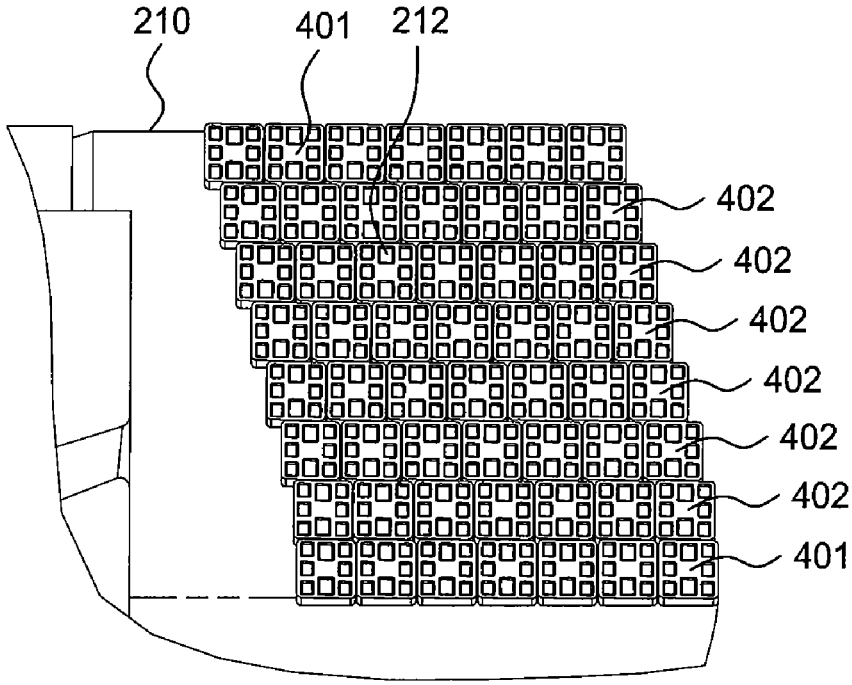
FIGS. 5A-5E are views of cutting structures of the milling tool according to one embodiment of the present invention.
Figure 5B:
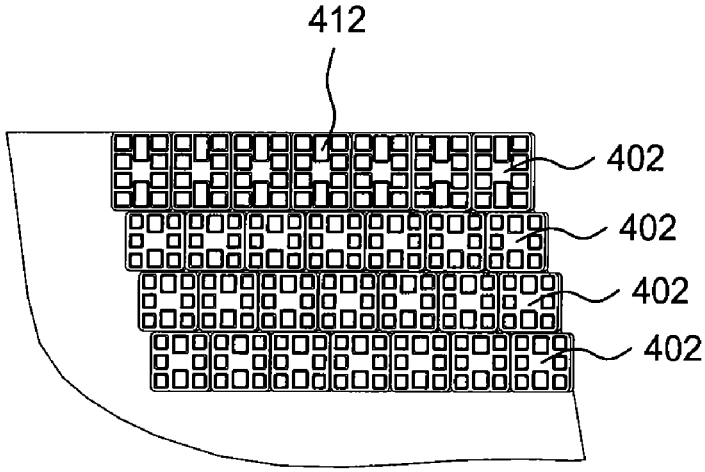
Figure 5C:
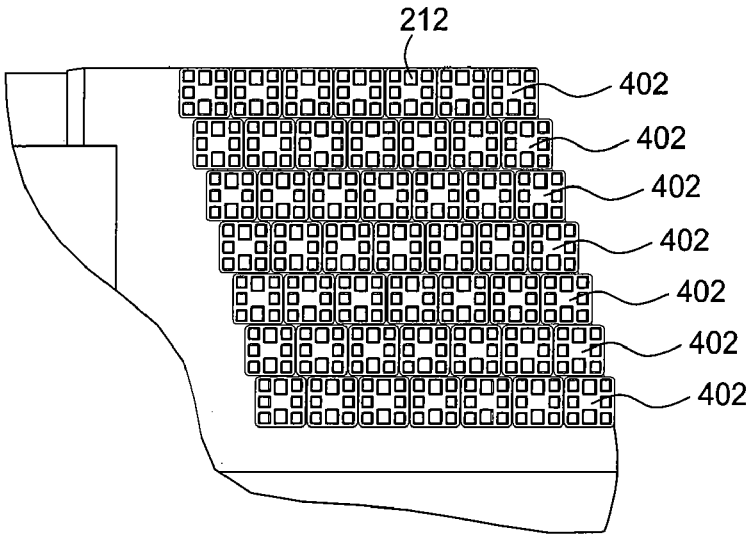
Figure 5D:
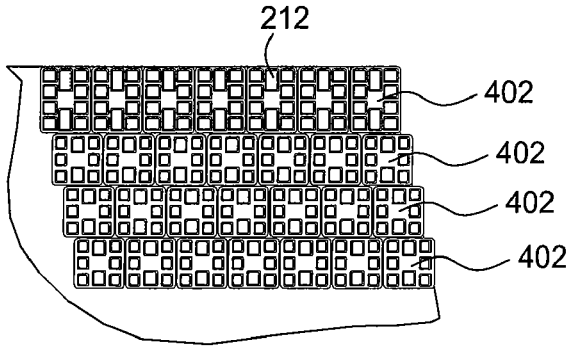
Figure 5E:
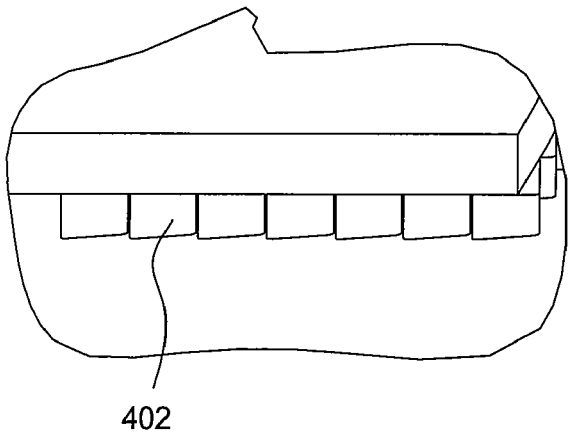

FIG. 4 shows a perspective view of milling end 204 of the milling tool. The one or more blades 210 are embedded in the face 208 as described above. The one or more blades 210 may extend radially beyond the face 208, as shown. When the one or more blades 210 extend beyond the face 208, the reinforcing member 216 may be included to structurally reinforce one or more outer edges 400 on the blades 210. The reinforcing members 216 may extend beyond the outer diameter of the body 200 and may be coupled to the coupling end 302 of the blades 210. As shown, the coupling end 302 of the blades 210 are flush with the reinforcing members 216; however, it should be appreciated that the coupling end 302 may be embedded into the reinforcing members 216.

The amorphous cutting structure 214 may be used to enhance mill life. The amorphous cutting structure 214 may comprise a crushed carbide with a support structure, such as brass, silver, nickel, plastic, fiber glass, etc, which is brazed onto the milling end 204 of the milling tool 110, in addition or alternatively the amorphous structure 214 may comprise inserts, PDC, a diamond impregnated matrix, or any suitable cutting structure or combination thereof. The amorphous structure 214 is shown attached to the face 208 and filling a space between created by the one or more blades 210. The amorphous structure 214, as shown, is filled to a height that is greater than the height of the blades 210; however, it should be appreciated that it could have any height. The amorphous structure 214 may also be placed on the cutting edge of the blades 210 in addition, or as an alternative, to the inserts 212. The amorphous structure 214 and the inserts 212 may mill the item 112.

Figure 6A:
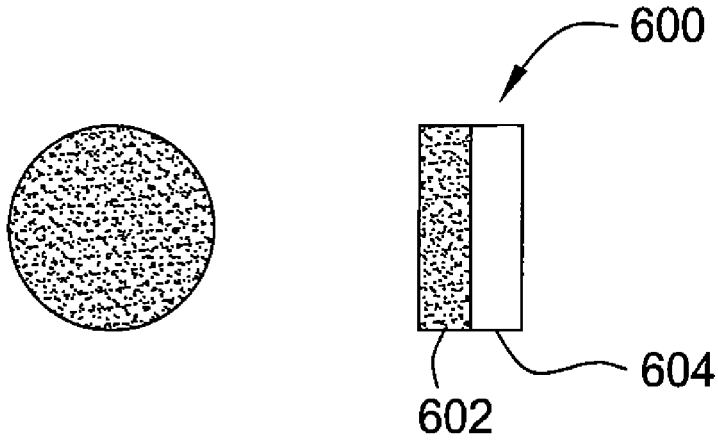
FIGS. 6A-6C illustrate a schematic of the cutting structure of the milling tool according to one embodiment of the present invention.
Figure 6B:
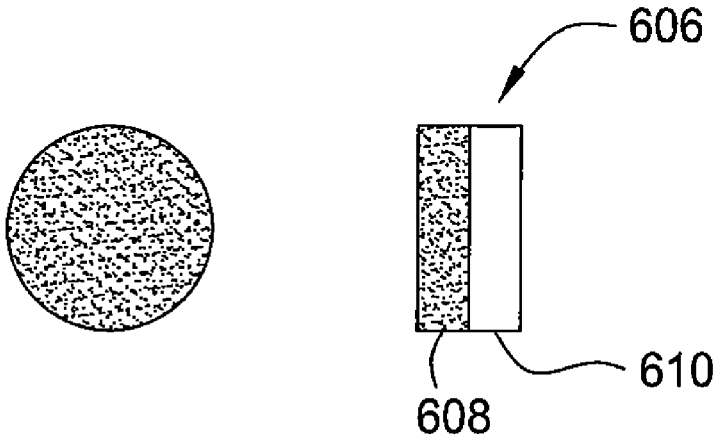
Figure 6C:
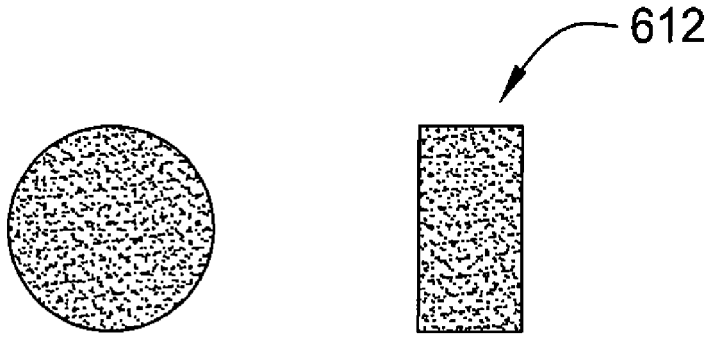

The inserts 212, as shown in FIG. 4, include one or more shaped structures 402 for containing the cutting structure coupled to the one or more blades 210. The shaped structures 402 may be in any configuration depending on the operation. FIGS. 5A-5E show embodiments of insert 212 configurations. The shaped structures 402 may have a variety of widths and shapes that may be placed in a staggered configuration. Further, the shaped structures 402 may include a variety of cutting structures in order to increase the life of the mill. In one embodiment, the cutting structure of the inserts 212 includes a layered carbide impregnated insert. The layered carbide impregnated insert includes one layer of a relatively harder tungsten carbide ball fill in a tungsten carbide matrix. For example the hard tungsten carbide ball fill may include a relatively low cobalt content (13% or less) and the tungsten carbide matrix may include a relatively high cobalt content (13%-20%). The second layer is a wear grade tungsten carbide. The carbide may be microwave sintered or applied using any known technique. FIG. 6A depicts the layered carbide impregnated insert 600. The layered carbide impregnated insert 200 may comprise an impregnated carbide layer 602 and a wear grade carbide layer 604. In an alternative embodiment, the insert 212 may be a layered diamond impregnated insert 606, as shown in FIG. 6B. The diamond impregnated insert 606 includes at least two layers. One of the layers is a diamond fill in a tungsten carbide matrix 608. The second layer is a wear grade tungsten carbide 610. The carbide may be microwave sintered or applied using any known technique. In yet another alternative embodiment, the insert 212 may be a full diamond impregnated insert 612, shown in FIG. 6C. This insert includes diamonds impregnated in tungsten. The carbide may be microwave sintered or applied using any known technique. Further, any suitable insert may be used. Any of these inserts may be used in combination.

Figure 7:
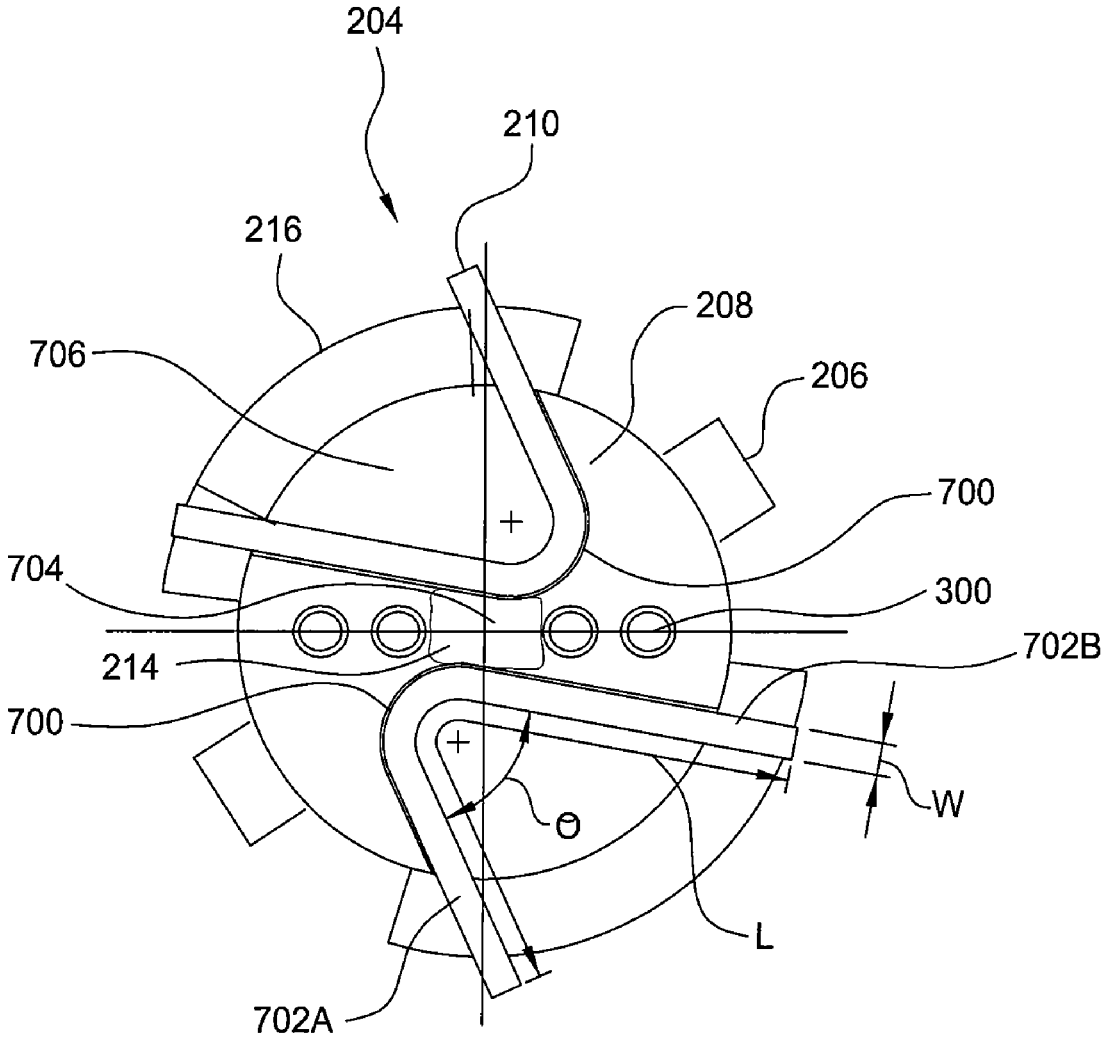
FIG. 7 is an end view of the milling tool according to one embodiment of the present invention.

In general, a minimum number of blades, typically 4 or more, are needed to provide smooth milling. By structurally joining two blades at an apex or bend, the blades provide for smooth milling and have an added stiffness. The increase in stiffness allows for the blades to increase in height thereby increasing the life of the milling tool 110. FIG. 7 shows an end view of the milling end 204. The one or more blades 210 are bent in a manner that gives the blades 210 a self supporting rigidity. The one or more blades 210 have a length L and a width W. The one or more blades 210 have a bend 700 formed in the blades 210. The bend 700 creates two blade legs 702A and 702B which extend from the bend at an angle θ. In one example the optimal angle is 50-60 degrees. The angle θ may be any suitable angle that gives the blades 210 self supporting rigidity. The length of each of the legs 702A and 702B may be equal or not equal depending on the milling operation. Deflection may be calculated using the following:

$$y_A := \frac{-W}{6 \cdot E \cdot I} \cdot (2 \cdot L^3 - 3 \cdot L^2 \cdot a + a^3)$$

Area moment of inertia=I (in^4)

Length of beam=L (ft)

Distance from left edge to load=a (ft)

Modulus of elasticity=E (lbf/in^2)

Load=W (lbf)

Increasing area moment of inertia [I] decreases deflection [y(a)]

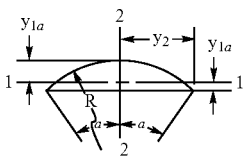

Radius: $R \equiv 6 \cdot in$
Angle: $\alpha \equiv 60 \cdot deg$

-continued $$I_2 := \frac{R^4}{12} \cdot [(3 \cdot \alpha - 3 \cdot \sin(\alpha) \cdot \cos(\alpha)) - 2 \cdot \sin(\alpha)^3 \cdot \cos(\alpha)] \qquad I_2 = 128.848\ in^4$$

Rectangle:

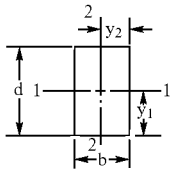

$$I_2 := \frac{1}{12} \cdot d \cdot b^3 \qquad I_2 = 6.859 \times 10^{-3}\ in^4$$

The legs 702A and 702B are shown as extending beyond the reinforcing structure 216; however, the legs 702A and 702B may be arranged to not extend beyond the reinforcing structure 216 or the face 208. Although the bend 700 is shown as having a constant radius, it should be appreciated that the angle θ may be created in any manner, for example two plates may be welded at a point thus having no bend, or the radius of curvature could vary between the legs 702A and 702B. Further, each blade may have more than two legs 702 all at various angles relative to one another. This geometry of the blades 210 allows the height of the blades to increase well beyond 2". In one embodiment, the height of the blades 210 is 4" beyond the face of the milling tool 110. As shown, there are two blades 210; however, any number of blades 210 may be arranged on the face 208 of the milling tool 110.

A center void 704 between the one or more blades 210 in the center of the face 208 may be filled with the amorphous structure 214, and/or one or more inserts. Further, a space 706 between the legs 702A and 702B may be filled with the amorphous structure 214. As discussed above, the cutting side of the blades 210 may have one or more cutting inserts 212. The face 208 may further include a compact cutting inserts 800, shown in FIGS. 8-11 located between the blades. The compact insert may be located in the center void 704 to alleviate the effects of coring during milling. The compact insert in the center void 704 allows the coring mechanism to enter the void 704 and then deflect toward the edge of the face 208 after contacting the compact insert.

Figure 8:
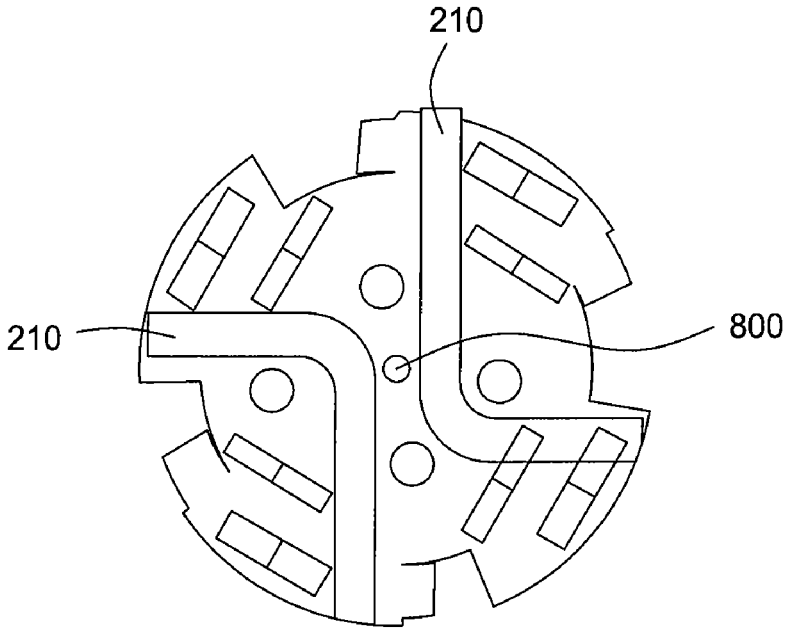
FIG. 8 is an end view of the milling tool according to one embodiment of the present invention.
Figure 9:
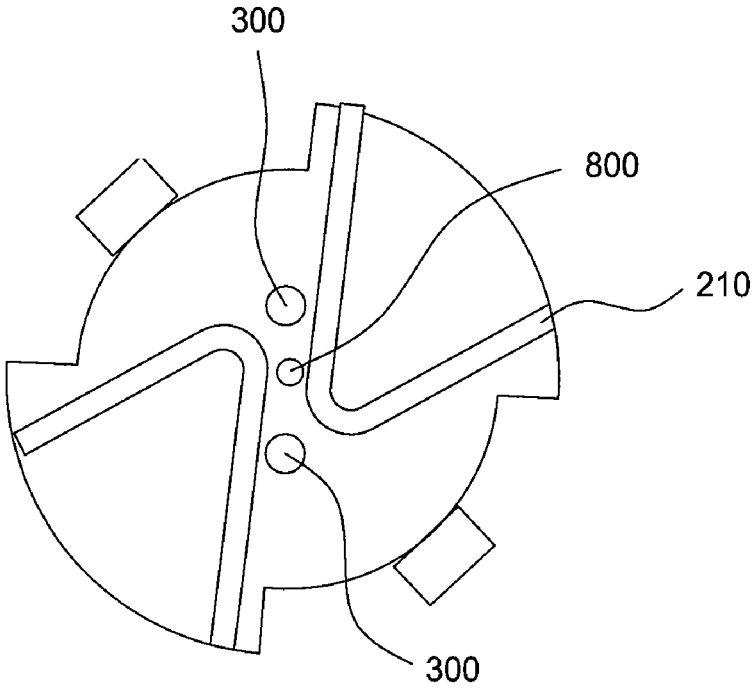
FIG. 9 is an end view of the milling tool according to one embodiment of the present invention.
Figure 10:
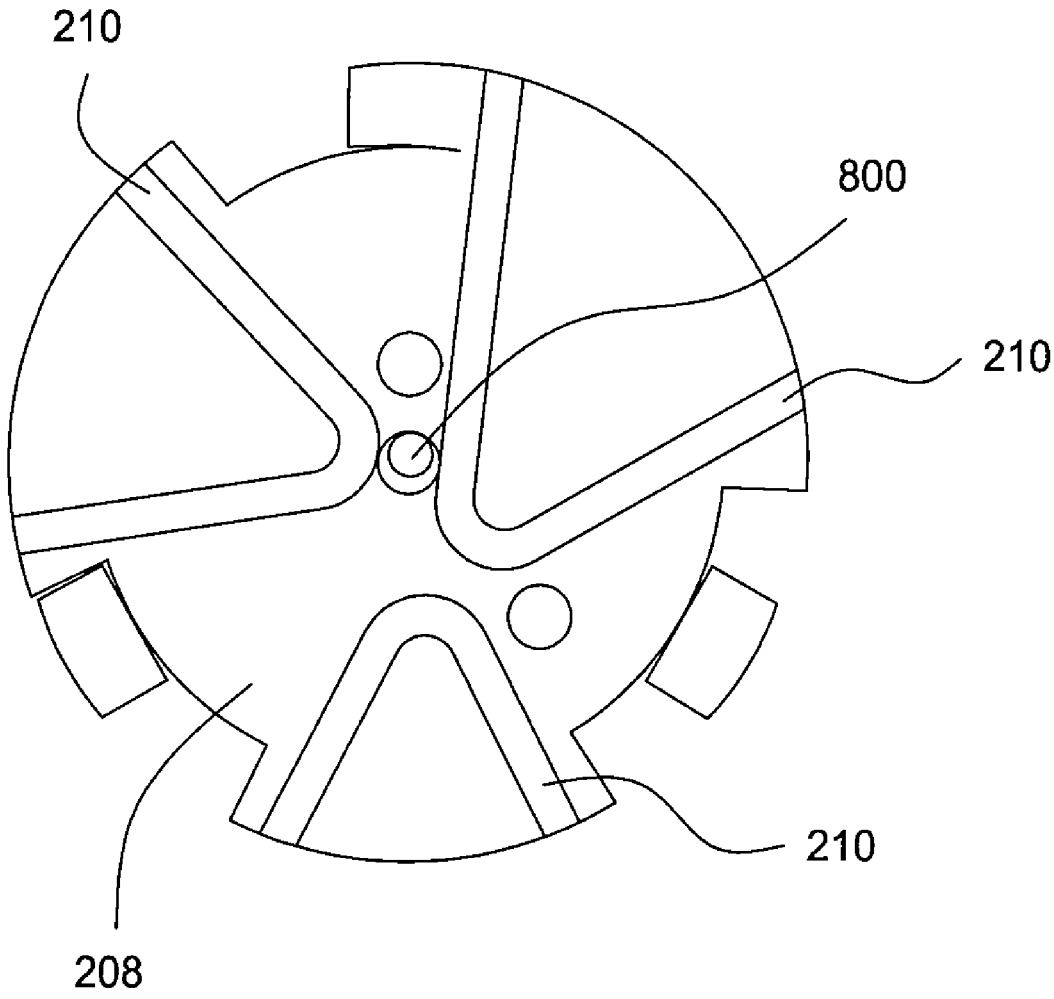
FIG. 10 is an end view of the milling tool according to one embodiment of the present invention.
Figure 11:
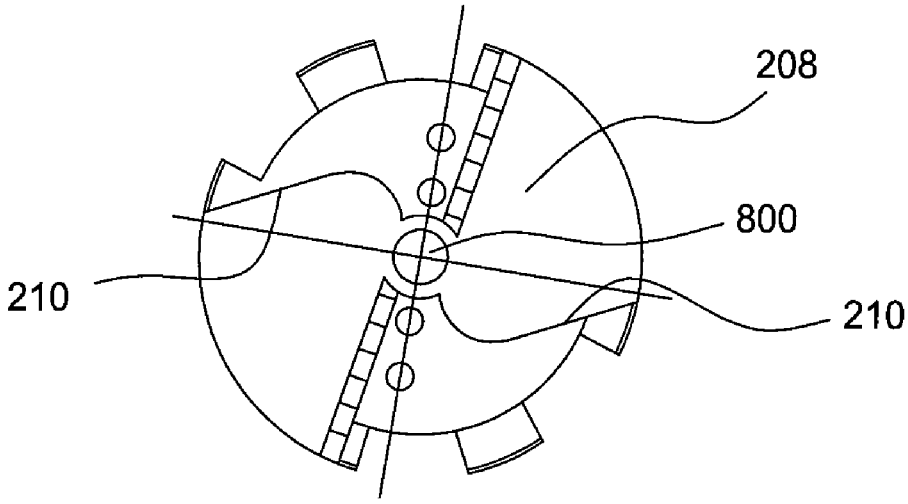
FIG. 11 is an end view of the milling tool according to one embodiment of the present invention.
Figure 12:
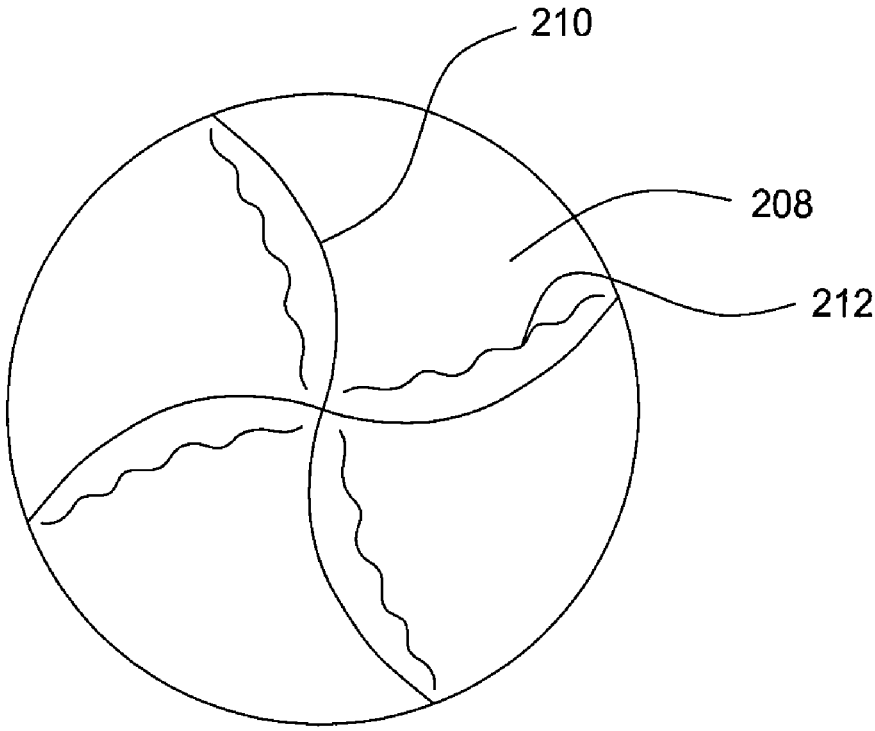
FIG. 12 is an end view of the milling tool according to one embodiment of the present invention.

FIGS. 8-12 show end views of the milling tool 110 having multiple blade configurations. FIG. 8 shows two L shaped blades with an optional compact insert located in the center void. FIG. 9 shows two V shaped blades with an optional compact insert located in the center void. FIG. 10 shows three V shaped blades with an optional compact insert located in the center void. FIG. 11 shows two J shaped blades with two straight blades. FIG. 12 shows, the bends of the blades be continuous along the length of the blade and having an S shape, or wave shape. Further, the blades 210 could have any suitable shape and/or include a number of patterns.

Although not show, it should be appreciated that the bend 700 of the blades may be positioned toward a radial exterior of the milling tool 110. In this embodiment, the legs 702A and 702B may extend from the bend toward the interior of the face, and/or toward another location on the radial exterior of the face. Further, there may be multiple blades 210 having bends 700 on the radial exterior of the face. These, multiple blades may have legs 702A and 702B which terminate adjacent to one another, or overlap one another.

In an alternative embodiment, the each of the blades 210 could have a different height H, or the height H of the blade 210 could vary along blade. Further, the milling tool 110 may be designed as a milling and drilling tool. For example the blades 210 may be designed for milling and drilling members may be located at a lower height than the height H of the blades 210. This allows for milling until the blades 210 wear down to the height of the drilling members at which time drilling may begin.

The contact area (the L multiplied by the W) of any of the blades 210 described above has a direct effect on the cutting speed and life of the blade 210. As the contact area is increased, the life of the milling tool 110 will increase however the speed at which the milling tool 110 mills is decreased. A contact pressure is created at the blades 210 by putting weight on the milling tool 110. The contact pressure is the weight divided by the contact area. When the weight is constant any loss of the contact area due to wear will increase the contact pressure of the blades. The increased contact pressure wears the blades at a greater rate, thus, affecting the life of the milling tool. Thus, optimal results occur when little or no contact area is lost during milling. The blades 210 are designed to expose the same amount of carbide as the height H of the blades 210 is worn down. Therefore, as the blades 210 are worn down the contact area remains substantially the same allowing the milling tool 110 to perform the same as milling continues.

In operation the milling tool 110 is coupled to the conveyance 108, such as a section of drill pipe at the surface. The milling tool 110 is run into the wellbore 100 as additional pipe joints are couple to the conveyance 108. The milling tool 110 is lowered until it is adjacent the stuck item 112 in the wellbore 100. The milling tool 110 may then be rotated in a cutting direction either by a downhole motor, and/or by rotating the conveyance 108 at the surface. Preferably the milling tool 110 is rotated as it is lowered into contact with the item 112 in order to commence the milling operation. An operator controls the amount of weight placed on the milling tool 110 and the rotational speed of the milling tool 110. The weight may be increased or decreased. While milling fluid flows through flow path 300 and out the face 208. The fluid lubricates the milling end 204 of the tool and pushes the cuttings toward the wellbore surface.

With the milling tool 110 rotating and in contact with the item 112, the one or more cutting structures, the inserts 212 and the amorphous structure 214 begin to mill away the item 112. When the amorphous structure 214 is placed above the height H of the blades 210, the amorphous structure 214 begins the milling. The amorphous structure 214 mills and wears down as it mills. It wears down until it is close to the blades 210 at which point both the inserts 212 and the amorphous structure 214 mill away at the item. With the inserts 212 milling, a cutting force may be exerted on the one or more blades 210. The cutting force will wear away the blades 210, the inserts 212 and the amorphous structure 214 while milling. The geometry of the blades 210 resists the cutting force, thereby decreasing the deflection of the blades 210. As the cutting force transfers to the blades, the cutting force will be dispersed along the legs 702A and 702B and through the bend 700. The bend 700 and the legs 702 create multi-directional resistance to the cutting force. The geometry allows a 4" blade to deflect less than 0.02" at the lower end, and/or the deflection per inch of the blade height is less than 0.01". The resistance to deflection may be increased by increasing the distance the blade 210 is embedded into the face 208 of the milling tool. Further, the amorphous structure 214 in the center void 204 and the space 706 increase the blades 210 resistance to deflection.

The milling tool 110 continues to rotate while the cutting structures are worn down. The configuration of the tool allows the milling tool 100 to operate up to 5 times longer than traditional milling tools. Therefore, the amount of rig time used to change milling tools 110 is reduced. When the milling operation is complete the milling tool 110 is run out of the wellbore 100. The wellbore 100 may then be accessed for continued production and drilling operations.

While the foregoing is directed to embodiments of the present invention, other and further embodiments of the invention may be devised without departing from the basic scope thereof, and the scope thereof is determined by the claims that follow.

The invention claimed is:

1. A milling tool for use in a wellbore, comprising:

a body having a connector end and a milling end; wherein the connector end is configured to couple the body to a conveyance; and wherein the milling end includes:

a face having one or more grooves, wherein the one or more grooves include two legs and a bend between the legs;

one or more blades having a height dimension which extends beyond the face and having a bend that creates two legs wherein each of the one or more blades couples to a corresponding groove of the one or more grooves such that a portion of the blade height is below a surface of the face and another portion extends beyond the surface of the face.

2. The milling tool of claim 1, further comprising an angle in the one or more blades, wherein the angle is between two blade legs which extend from an interior of the face radially outward to an exterior edge of the face.

3. The milling tool of claim 1, further comprising one or more cutting structures coupled to the milling end of the milling tool.

4. The milling tool of claim 3, wherein one of the cutting structures comprises an amorphous cutting structure.

5. The milling tool of claim 4, wherein the amorphous cutting structure is located in a space between two or more legs of the one or more blades.

6. The milling tool of claim 5, wherein the amorphous cutting structure is located substantially in the center of the face between two or more blades.

7. The milling tool of claim 4, wherein the amorphous cutting structure is crushed carbide.

8. The milling tool of claim 3, wherein one of the cutting structures comprises an insert.

9. The milling tool of claim 8, wherein the insert is a layered carbide impregnated insert.

10. The milling tool of claim 9, wherein the layered carbide impregnated insert comprises one layer of hard tungsten carbide balls that are impregnated in a softer tungsten matrix.

11. The milling tool of claim 10, wherein the layered carbide impregnated insert comprises a second layer that is a wear grade tungsten carbide.

12. The milling tool of claim 10, wherein the layered carbide is microwave sintered.

13. The milling tool of claim 1, wherein the portion of the blade height below the surface of the face is shorter than the portion beyond the surface.

14. The milling tool of claim 1, wherein the height dimension is greater than 3.5".

15. The milling tool of claim 1, further comprising one or more support members disposed around the body, wherein the one or more support members is configured to support a portion of the legs.

16. The milling tool of claim 1, wherein one or more inserts are disposed on one side of each leg.

17. The milling tool of claim 1, wherein the bend between the two legs of the one or more blades is between 50 to 60 degrees.

18. A method for milling an item in a wellbore, the method comprising:

providing a milling tool having a milling end, wherein the milling end comprises a face and one or more having a bend portion coupled to a respective groove formed in the face of the milling end, wherein the groove includes a respective bend portion for mating with the bend portion of the one or more blades;

coupling the milling tool to a conveyance;

running the conveyance into a wellbore;

rotating the milling tool;

engaging the item with the milling end; and milling the item with the one or more blades.

19. The method of claim 18, further comprising providing an amorphous cutting structure on the face of the milling end.

20. The method of claim 18, further comprising flowing a fluid through one or more ports on the face of the milling tool while milling.

21. The method of claim 18, further comprising dispersing a cutting force through the bend portion of the one or more blades during milling.

22. A milling tool configured to mill in a wellbore, the milling tool comprising:

a face having two or more individual grooves, wherein each of the two or more grooves includes two legs and a bend between the legs; and two or more individual blades disposed on the face, wherein the two or more individual blades include two legs and a bend located between the legs that mate with a respective groove on the face.

23. The milling tool of claim 22, wherein the bend of at least one of the two or more blades is located toward a radial interior of the face and each of the legs extend radially outward along the face.

24. The milling tool of claim 22, wherein the bend of at least one of the two or more blades is configured to disperse a cutting force from one of the legs to the other during a milling operation.

25. The milling tool of claim 22, wherein the bend of at least one of the two or more blades is configured to resist deflection with the blade by distributing cutting forces in the legs.

26. The milling tool of claim 22, further comprising a plurality of amorphous structures disposed in a space between two of the two or more blades.

27. The milling tool of claim 22, further comprising a plurality of amorphous structures disposed on an area defined between two legs of one of the two or more blades.

28. The milling tool of claim 22, wherein the bend between the two legs of one of the two or more blades is between 50 to 60 degrees.

29. A method for milling an item in a wellbore, the method comprising:

providing a milling tool having milling end, wherein the milling end comprises a face, a first blade and a second blade, wherein the blades are not connected to each other and wherein each blade comprises two legs and a bend portion and mates with a groove having two legs and a bend formed in the face;

coupling the milling tool to a conveyance;

running the conveyance into a wellbore;

rotating the milling tool;

engaging the item with the milling end;

dispersing a cutting force through the bend of at least one of the blades; and cutting the item with the blades coupled to the milling end.

* * * * *

UNITED STATES PATENT AND TRADEMARK OFFICE

CERTIFICATE OF CORRECTION

PATENT NO. : 7,823,665 B2
APPLICATION NO. : 11/834764
DATED : November 2, 2010
INVENTOR(S) : Sullivan et al.

It is certified that error appears in the above-identified patent and that said Letters Patent is hereby corrected as shown below:

In the Claims:

Column 9, Claim 18, Line 9, please insert --blades-- after more.

Signed and Sealed this
Twenty-second Day of March, 2011

David J. Kappos

David J. Kappos
*Director of the United States Patent and Trademark Office*